United States Patent [19]

Kao

[11] Patent Number: 4,866,933

[45] Date of Patent: Sep. 19, 1989

[54] EXHAUST SILENCER

[75] Inventor: Whau Chih Kao, 4th Fl., NO. 28, How Gaang Rd., Shin Juang, Taipei Hsien, Taiwan

[73] Assignees: Whau Chih Kao, Taipei Hsien; Chan-Yan Wang; Shih Po-Hsiang, both of Taipei, all of Taiwan

[21] Appl. No.: 247,285

[22] Filed: Sep. 21, 1988

[51] Int. Cl.[4] ..... F02B 27/02; F01N 1/00

[52] U.S. Cl. ..... 60/312; 181/236; 181/253; 181/254

[58] Field of Search ..... 60/312; 181/236, 253, 181/254

[56] References Cited

U.S. PATENT DOCUMENTS 2,157,030 5/1939 Starkweather ..... 181/254
4,665,692 5/1987 Inaba ..... 181/254

*Primary Examiner*—Douglas Hart
*Attorney, Agent, or Firm*—Browdy and Neimark

[57] ABSTRACT

An exhaust silencer for a car includes a housing, a partitioning diaphragm plate, a conduction pipe for conducting therethrough an exhaust gas from the car engine, an exhaust pipe exhausting thereout the exhaust gas to the atmosphere, an exhaust conduit capable of exhausting therethrough the exhaust gas, a valve mounted in the conduit, and a controlling device responsive to the rpm of the car engine for enabling the valve to/not to block up the conduit so that the exhaust gas can be exhausted to the atmosphere in a quicker manner, if desired.

2 Claims, 3 Drawing Sheets

EXHAUST SILENCER

BACKGROUND OF THE INVENTION

The present invention relates to a silencer, and more particularly to an exhaust silencer.

In order to reduce the exhausting noise, the exhaust pipe of a car normally is provided with an exhaust silencer 1 which, as shown in FIG. 1, includes a cylindrical housing 2 having two end covers 3, 4 and a receiving room 5, two diaphragm plates 6, 7 partitioning receiving room 5 into 3 chambers 8, 9, 10 and oppositely provided with a plurality of parallel slots 11, 12 for communicating chambers 8, 9, 10, a conduction pipe 13 mounted on end cover 3 for conducting therethrough an exhaust gas of the car engine and having an end blocked by and secured to diaphragm plate 6 and a plurality of perforations 14 in chamber 8, and an exhaust pipe 15 mounted on end cover 4 for exhausting thereout the exhaust gas to the atmosphere and having an end blocked by and secured to diaphragm plate 7 and a plurality of perforations 16 in chamber 10. Exhausting through the winding path constituted by conduction pipe 13, perforations 14, chamber 8, slots 11, chamber 9, slots 12, chamber 10, perforations 16 and exhaust pipe 15 in which wave-interfering action takes place, the noise accompanying the exhaust gas is effectively reduced. Since such winding path forms a relatively great resistance for the exhaust gas, the load of the car engine is correspondingly increased and the horsepower output of the engine is thus lowered accordingly. This situation will become more outstanding when the car is climbing an inclined road with a greater horsepower, and therefore is tried to be alleviated by the Applicant.

SUMMARY OF THE INVENTION

It is therefore an object of the present invention to provide an exhaust silencer capable of increasing the horsepower output when the car is running at a relatively low rpm.

It is further an object of the present invention to provide an exhaust silencer automatically responsive to the rpm of the car engine.

According to the present invention, an exhaust silencer for a car includes a housing, at least one partitioning diaphragm plate, a conduction pipe conducting therethrough the exhaust gas of the car engine and an exhaust pipe for exhausting thereout the exhaust gas to the atmosphere, characterized by further including an exhaust conduit secured to the housing and capable of exhausting therethrough the exhaust gas, a valve mounted in the exhaust conduit, and a controlling means responsive to the rpm of the car engine and connected to the valve for enabling the valve to block or not to block up the exhaust conduit.

The present invention may best be understood through the following description with reference to the accompanying drawings, in which:

DETAILED DESCRIPTION OF THE PREFERRED EMBODIMENT

Figure 1:
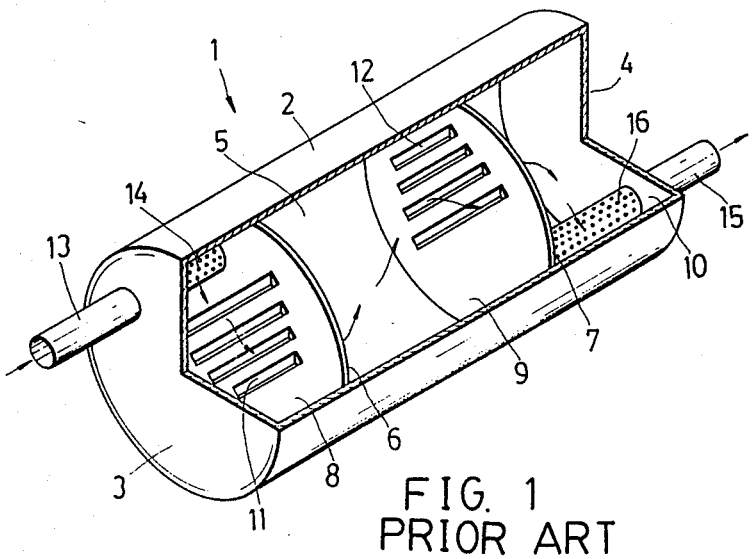
FIG. 1 PRIOR ART
FIG. 1 is a partly sectional view of an exhaust silencer according to the prior art.
Figure 2:
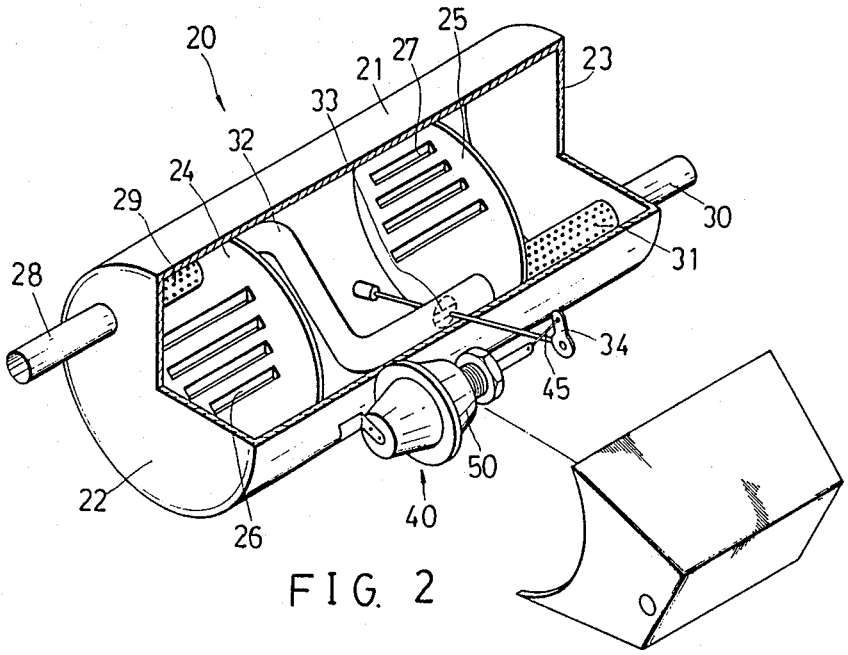
FIG. 2 is a partly sectional view of an exhaust silencer according to a first preferred embodiment of the present invention.
Figure 3:
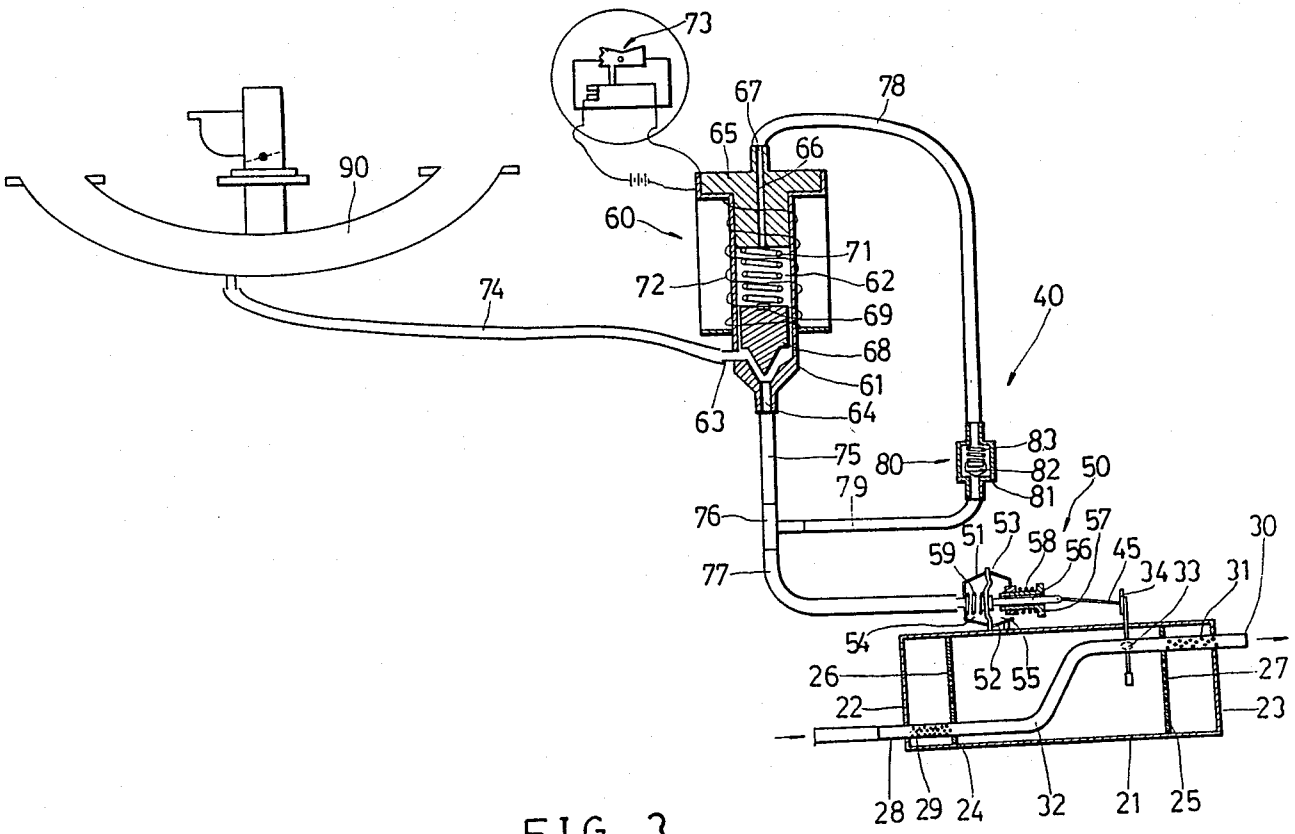
FIG. 3 is a schematically sectional view showing a controlling means of an exhaust silencer in FIG. 2.

Referring now to FIGS. 2 & 3, a first preferred embodiment of the present exhaust silencer 20 includes a cylindrical housing 21, two end covers 22, 23, two diaphragm plates 24, 25 oppositely provided with a plurality of parrellel slots 26, 27, a conduction pipe 28 secured on end cover 22 and diaphragm plate 24 and having perforations 29 in housing 21, an exhaust pipe 30 mounted on end cover 23 and diaphragm plate 25 and having perforations 31 in housing 21, a Z-shaped exhaust conduit 32 having an end connected to conduction pipe 28 and an opposite end connected to exhaust pipe 30 for capable of rapidly exhausting therethrough the exhaust gas, a valve 33 mounted in exhaust conduit 32 and a controlling means 40 responsive to the engine rpm for enabling valve 33 to block or not to block up exhaust conduit 33.

Controlling means 40 includes an actuating device 50, a connecting rod 45, an electromagnetic valve 60, passages 74, 75, 77, 78, 79 and a uni-directional (check) valve 80. Actuating device 40 includes two bowl-shaped housings 51, 52 cooperating to form therein a receiving cavity, an elastic diaphragm 53 mounted between housings 51, 52 for partitioning the receiving cavity into two isolated chambers 54, 55, a plunger 56 having an end centrally secured to diaphragm 53, an adjusting bolt 57 screwed to housing 52 and slidably mounting therein plunger 56 for limiting the sliding displacement of plunger 56, a positioning spring 58 mounted between housing 52 and bolt 57 for auxiliarily positioning bolt 57, and a restoring spring 59 mounted in chamber 54 and between housing 51 and diaphragm 53. Connecting rod 45 is connected between an opposite end of plunger 56 and an actuating medium 34 of valve 33.

Electromagnetic valve 60 includes a housing 61 having a receiving room 62 having a conical end having a first joint 63 and a second joint 64 respectively communicating with room 62, an iron core 65 closing receiving room 62 and having a central through hole 66 forming at the top end a third joint 67, a rubber piston 68 received in receiving room 62 and having a conical end capable of blocking up second joint 64 and an opposite end attaching thereto a magnetizable metal 69, a spring 71 mounted in room 62 and between core 65 and piston 68, a coil 72 wound around housing 61 and connected to the car battery, and a switch 73 electrically connected in series with coil 72 so that when coil 72 is energized, iron core 65 will be induced to be magnetic to attract thereto piston 68 to thus block up third joint 67 and to leave first and second joints 63 & 64 in communication with each other and when de-energized, spring 71 and the gravity of rubber piston 68 force piston 68 downwardly to block up second joint 64 and to leave first and third joints 63, 67 in communication with each other.

The first passage 74 has an end connected to the intake manifold 90 for the car engine and an opposite end connected to first joint 63. The second passage mounts thereto a T-joint 76 and includes an upper portion 75 connected to second joint 64 and a lower portion 77 connected to housing 51 and communicating with chamber 54. The third passage mounts therein a check valve 80 and includes an upper portion 78 connected to third joint 67 and a lower portion 79 connected to T-joint 76 for communicating with the second passage. Uni-directional valve 80 includes a housing 81, a piston 82 in housing 81 and a spring 83 biassing piston 82 against housing 81 in order that the air can only uni-directionally flow from lower portion 79 to upper portion 78.

When the car engine is shut off, exhaust conduit 32 is in a conduction state. When the engine is started and has a relatively high rpm and switch 73 is switched on, first passage 74, electromagnetic valve 60, upper portion 75, T-joint 76 and lower portion 77 constitute a free passage through which the vacuum suction force produced at intake manifold 90 sucks backwards elastic diaphragm 53 accompanied by plunger 56 which in turn enables valve 33 to block up exhaust conduit 32 which means that exhaust silencer 20 acts no differently from the prior silencer in having a muffling effect. When the car is climbing on an inclined road or the engine is at a relatively low rpm, the vacuum suction force produced by the reduced intake air volume is relatively smaller and spring 59 will force forwards elastic diaphragm 53 and plunger 56 to open exhaust conduit 32 through which the exhaust gas can effectively and directly be discharged to be exhausted to the atmosphere from exhaust pipe 30 so that the lost horsepower through the provision of the exhaust silencer is thus partly recovered so as to "increase" the horsepower output of the car engine. Although at this time the silencing effect of exhaust silencer 20 appears to be reduced, it does not affect exhaust silencer 20 since now the car engine is at a relatively low rpm and thus the exhausting noise is relatively low accordingly.

When switch 73 is switched off so that second joint 64 is blocked up by piston 68, first passage 74, electromagnetic valve 60, upper portion 78, check valve 80, lower portion 79, T-joint 76 and lower portion 77 constitute a free passage through which the vacuum suction force resulted at intake manifold 90 sucks backward elastic diaphragm 53 and plunger 56 to block up exhaust conduit 32 so that the present exhaust silencer 20 will function as same as the prior art one. Thus, when switch 73 is switched off, the present silencer 20 acts as the prior silencer. When switch 73 is switched on, exhaust conduit 32 will be or will not be blocked up by valve 33 in automatic response to a relatively high/low rpm of the car engine. Certainly, the degree that exhaust conduit 32 is opened is determined by the sliding displacement of plunger 56.

Figure 4:
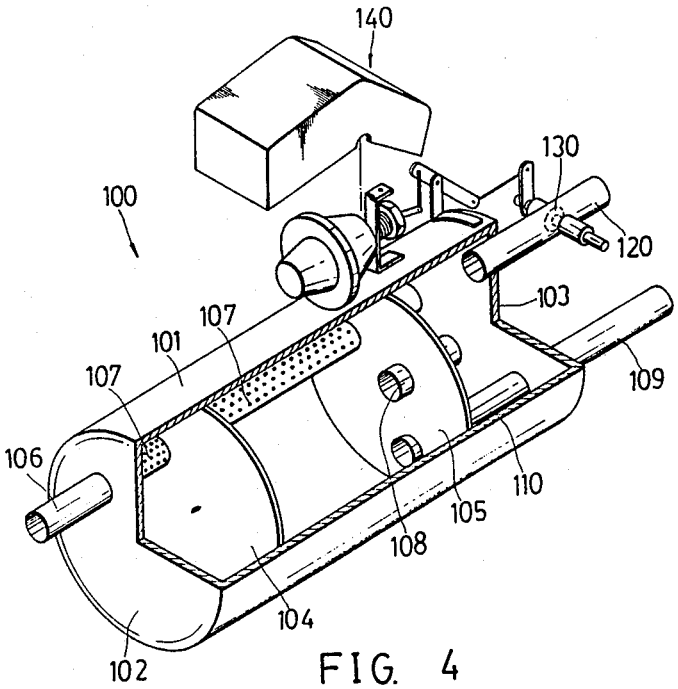
FIG. 4 is a partly sectional view of an exhaust silencer according to a second preferred embodiment of the present invention.

As shown in FIG. 4, a second preferred embodiment of the present exhaust silencer 100 includes a cylindrical housing 101, two end covers 102, 103, two partitioning diaphagm plates 104, 105, a conduction pipe 106 secured on end cover 102 and diaphragm plates 104, 105 and having perforations 107 in housing 101, a communicating pipe 108 mounted on diaphragm plate 105, an exhaust pipe 109 mounted on end cover 103 and diaphragm plate 105, an exhaust conduit 120 having a first end spacedly and axially aligned with conduction pipe 106 and a second opposite end communicating with the atmosphere, a valve 130 mounted in exhaust conduit 120, and a controlling means 140 controlling valve 130 and having a function and a structure the same as those of controlling means 30 in the first preferred embodiment of the present invention as shown in FIG. 3.

Figure 5:
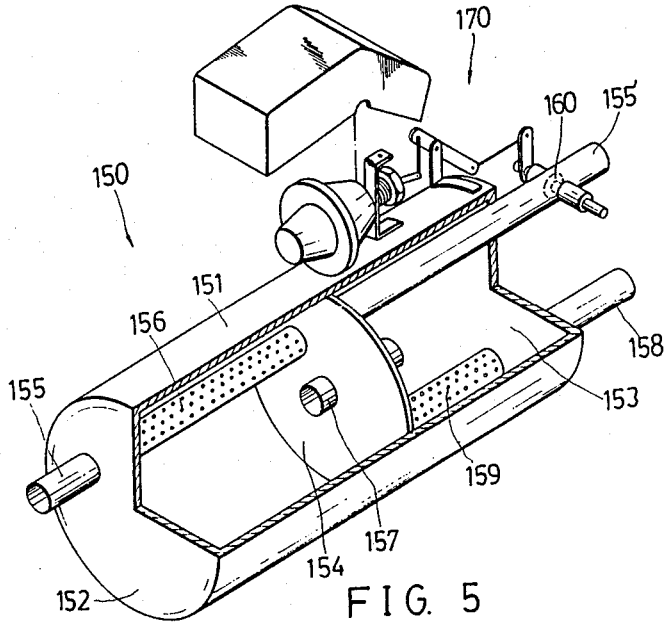
FIG. 5 is a partly sectional view of an exhaust silencer according to a third preferred embodiment of the present invention.

As shown in FIG. 5, a third preferred embodiment of the present exhaust silencer 150 includes a housing 151, two end covers 152, 153, a diaphragm plate 154, a conduction pipe 155 mounted on end covers 152, 153 and diaphragm plate 154 and having a perforated portion 156 and an exhaust conduit portion 155', a communicating pipe 157 mounted on diaphragm plate 154, an exhaust pipe 158 mounted on end cover 153 and diphragm plate 154 and having perforations 159 in housing 151, a valve mounted in exhaust conduit portion 155', and a controlling means 170 having a function and a structure the same with those of controlling means 30 as described in the first preferred embodiment of the present invention.

The latter two embodiments according to the present invention can more effectively and directly discharge the exhaust gas than the first embodiment so that they will recover more lost power than the first embodiment.

Through the above description, it should now become readily apparent how and why the present invention can achieve the objects it contemplates.

What I claim is:

1. An exhaust silencer for a car comprising a housing having a receiving room, at least one diaphragm plate mounted in said housing for partitioning said receiving room into a plurality of chambers and having a communicating device for communicating said chambers, a conduction pipe mounted in said housing for conducting therethrough an exhaust gas of an engine of said car and being perforated in said housing, and an exhaust pipe mounted in said housing for exhausting thereout said exhaust gas to the atmosphere, wherein said exhaust silencer further includes:

an exhaust conduit secured to said housing and capable of exhausting therethrough said exhaust gas;

a valve mounted in said exhaust conduit;

a controlling means responsive to an rpm of said engine and connected to said valve for enabling the valve to block up said conduit;

wherein said exhaust conduit has a first end connected to said conduction pipe and a second opposite end connected to said exhaust pipe;

wherein said controlling means includes:

a second housing having a receiving cavity;

an elastic diaphragm mounted in said second housing for partitioning said receiving cavity into two isolated chambers;

a plunger slidably secured to said second housing and having a first end secured to said elastic diaphragm and a second opposite end connected to said valve;

an elastic member mounted between said second housing and said elastic diaphragm for restoring said elastic diaphragm into position when not actuated;

an electromagnetic valve having a first, a second, and a third joint in which said first and second joints communicate with each other when said electromagnetic valve is energized and said first and third joints communicate with each other when de-energized;

a first passage having a first end connected to said first joint and a second opposite end communicating with an intake manifold for said engine;

a second passage having an end connected to said second joint and an opposite end connected to said second housing for actuating said elastic diaphragm to slide said plunger to operate said valve in said conduit;

a third passage having an end connected to said third joint and an opposite end communicating with said second passage; and a unidirectional valve mounted in said third passage and only permitting air to flow from said second passage to said third passage.

2. An exhaust silencer according to claim 1 wherein said communicating device includes a plurality of parallel slots.

* * * * *